United States Patent [19]

Baxter

[11] 4,313,604

[45] Feb. 2, 1982

[54] GOLF TEE AND BALL STICK DEVICE

[76] Inventor: G. Matthews Baxter, 589 Sheridan Rd., Glencoe, Ill. 60022

[21] Appl. No.: 109,152

[22] Filed: Jan. 2, 1980

[51] Int. Cl.[3] ..... A63B 57/00

[52] U.S. Cl. ..... 273/32 A; 273/32 F; 273/33

[58] Field of Search ..... 273/33, 32 B, 32 A, 273/32 F, 162 E, 202–212; 294/19 A

[56] References Cited

U.S. PATENT DOCUMENTS

| | | | |
|---|---|---|---|
| 2,606,764 | 8/1952 | Mason | 273/33 |
| 2,609,198 | 9/1952 | Armstrong | 273/33 |
| 2,943,856 | 7/1960 | Eimerman | 273/33 |
| 3,074,719 | 1/1963 | McKee | 273/33 |
| 3,206,197 | 9/1965 | Miotke | 273/33 |
| 3,224,781 | 12/1965 | Hutchinson | 273/33 |
| 3,671,037 | 6/1972 | Murdock, Jr. | 273/33 |
| 3,889,946 | 6/1975 | Setecke | 273/33 |
| 3,904,200 | 9/1975 | Jackle | 273/33 |
| 4,013,295 | 3/1977 | Baugham | 273/33 |
| 4,142,719 | 3/1979 | Blood | 273/33 |

*Primary Examiner*—Richard C. Pinkham
*Assistant Examiner*—T. Brown
*Attorney, Agent, or Firm*—Jerome Goldberg

[57] ABSTRACT

A tee and ball stick device for use by golf players having back problems or difficulty bending over, and the stick device is utilized for inserting the tee in the ground and positioning the golf ball thereon, retrieving the tee, whether embedded in the ground or lying loose on the ground, and also retrieving the ball.

The device includes a spring for releasably holding the tee and an adjustable cap for contacting the tee, and inserting the tee into the ground upon the application of downward pressure; a seat having a hole therein is provided for holding the golf ball and positioning the ball on the tee, and a channel opening leading into the hole enables the stick to accurately position the ball on the tee and for the stick to be removed after the ball is placed on the tee; a ramp leading into the seat provides a path for rolling the ball on to the seat; a jaw including a notch enables the tee to be pulled out from the ground; a pair of tongs lifts the tee lying on the ground into a cradle arrangement, and the tongs further enable the golf ball to be pushed out from the cup inside the hole after sinking the putt; and a slot and platform are provided for holding a ball marker to be inserted on the green in place of the ball to permit putting by the other players without the obstruction of the ball, and a cut out area is also provided in the platform, to receive a pin, in the event, the ball marker includes a pin for securing the marker in the ground.

21 Claims, 14 Drawing Figures

GOLF TEE AND BALL STICK DEVICE

BACKGROUND OF INVENTION

Previously, a golf player having a problem kneeling or bending over either couldn't actively participate in the sport or did so only with great difficulty. This was the case eventhough a substantial body of prior art does exist disclosing various devices for assisting the incapacitated golf player. These prior devices usually were very cumbersome and time consuming to manipulate, and furthermore required one device for inserting the tee in the ground and positioning the golf ball thereon, and another device for retrieving the golf ball.

Even if these prior devices were used, it still required the player or another person to bend over to retrieve the tee whether embedded in the ground or loosely lying on the ground. Therefore, these devices afforded the handicapped or incapacitated player limited access to the golf game, and did not enable him to independently pursue the sport. The subject invention, on the other hand, enables the player who is unable to kneel or bend over, to fully engage in the sport.

Accordingly, it is a primary object of the subject invention to provide a golf tee and ball stick device for the player unable to or having difficulty kneeling or bending over, which may be used to insert the tee in the ground, position the golf ball thereon, retrieve the golf ball and retrieve the tee whether the tee is secured in the ground or lying loose on the ground.

Another object is to provide a golf tee and ball stick device which is simply manipulated and easily carried from one location to another.

Still another object is to provide a device which also enables a flat ball marker to be placed on or into the ground in place of the ball.

SUMMARY OF INVENTION

It has been found that the foregoing and related objects of the present invention are readily attained in a combination including a handle member attached to a head, and the head comprising a spring member for holding a tee and an abutting cap for contacting the tee upon applying a downward force to the handle, to cause the tee to be inserted in the ground. A groove is formed in the body of the head for rolling the golf ball into a seat. A pair of spaced apart tongs extend outward from the body of the head to define a channel therebetween. When positioning the golf ball on the tee, the ball is deposited in the seat and the stick is lowered to permit the tee to extend into an opening of the seat for the top of the tee to lift the ball out of the seat. Thereafter, the stick is backed away from the ball and tee, leaving the ball resting on the tee. The channel between the tongs enables the ball to be brought accurately to the tee for placement thereon, and also affords a pathway for pulling the stick away from the ball and tee. One of the tongs includes a notch therein for lifting the tee out from the ground. A ledge is also formed in the tongs to receive and support the tee after the tee lying on the ground is lifted upward with the forward ends of the tongs and on to the ledges. The head of the stick further comprises a slot therein for holding a ball marker to be positioned on or into the ground in place of the ball.

BRIEF DESCRIPTION OF THE DRAWINGS

Referring now to the drawings, in which the same characters of reference are employed to indicate corresponding similar parts throughout the several figures of the drawings.

DESCRIPTION OF THE PREFERRED EMBODIMENT

Figure 1:
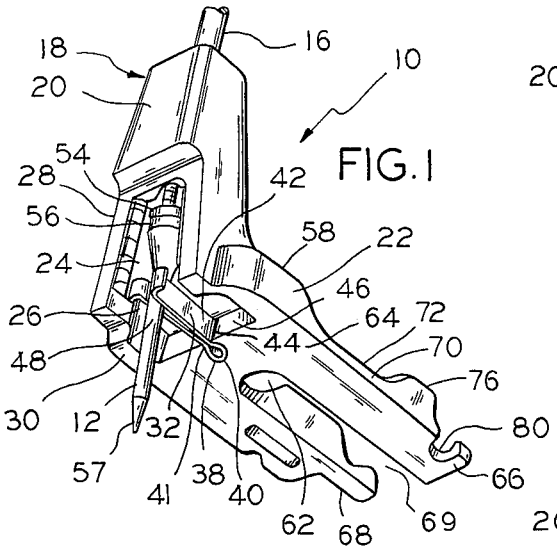
FIG. 1 is a bottom rear perspective view of the tee and ball stick device and showing the tee secured therein prior to inserting the tee into the ground.
Figure 4:
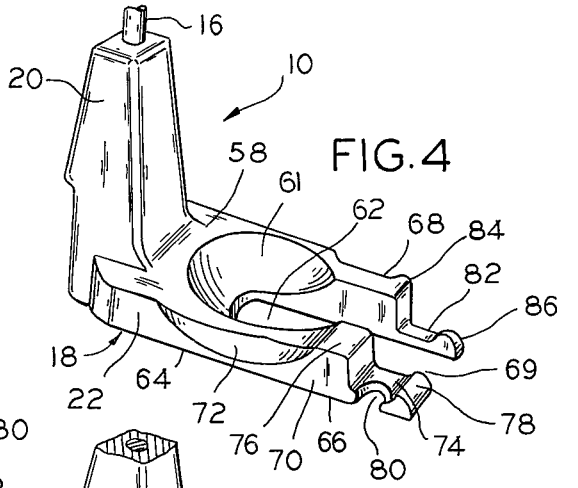
FIG. 4 is a front side view of the tee and ball stick device.

Referring now generally to FIGS. 1 thru 11 of the drawings, the reference 10 indicates a golf tee and ball stick or club device suitable for use by golf players having back problems or otherwise having difficulty inserting the tee 12 into the ground, positioning the ball 14 on the tee or retrieving the tee and ball from the ground.

The tee stick device 10 includes a narrow handle 16 attached at the inner end thereof to a head 18 embodying the principles of the invention. The head 18 has a substantially right angular shape and includes a vertical leg 20 and a horizontal leg 22, which may be formed in a single piece.

As may be seen from FIG. 1 of the drawings, a cavity 24 is formed inside the vertical leg 20 of the head 18, and leads to the outside via the substantially right angular opening 26 cut out from the back wall 28 and bottom wall 30 of the vertical leg 20. A spring member 32 is positioned inside the cavity 24 to receive and hold the tee 12.

Figure 13:
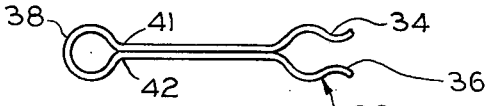
FIG. 13 illustrates the spring clip for holding the tee.

The spring member 32 is an expandable clip having a pair of fingers 34, 36 integrally connected together by a short cylindrical joint 38 (FIG. 13). The joint 38 is press fitted inside the cylindrical aperture 40 located in the bottom wall 30 of the vertical leg 20 of the head 18, and the inner ends 41, 42 of the fingers pass through a slit 44 in the inner wall 46. The slit 44 extends upward from the bottom wall 30 in communication with the aperture 40. The bending of the inner ends 41, 42 secures the spring 32 in place. The fingers 34, 36 are normally together and are spread apart for inserting the stem 48 of the tee 12, to resiliently hold the tee 12 tightly in the grasp of the spring fingers 34, 36.

Figure 2:
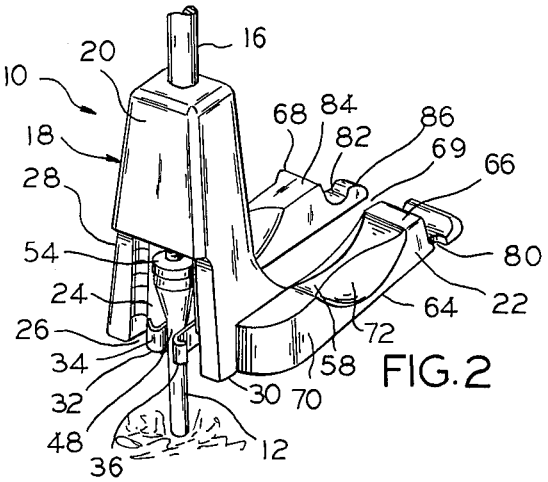
FIG. 2 illustrates the stick with the tee partially inserted in the ground.
Figure 3:
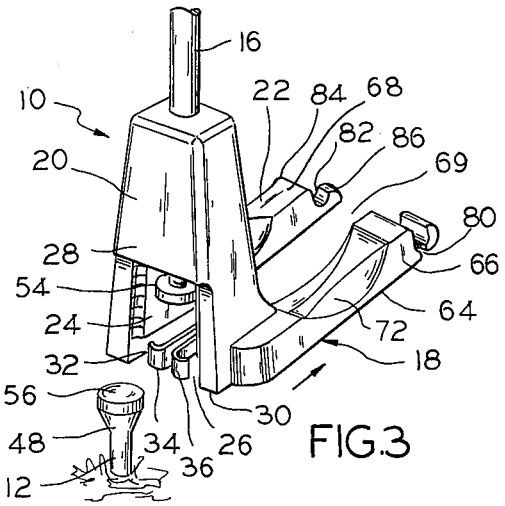
FIG. 3 shows the tee in the ground and the stick device spaced from the tee after the tee had been released.

A screw 50 is threadedly received in the threaded opening 52 formed inside the vertical leg 20. The cap 54 of the screw 50 reaches downward into the cavity 24 for contacting the top 56 of the tee 12, to provide an abutting or contacting surface (FIGS. 1, 2 and 3). The greater the portion of the screw 50 that extends into the cavity 24, the more of the tee 12 is available for inserting into the ground. Hence, the screw 50 serves as an adjustible stop for setting the depth the tee 12 is inserted into the ground, and further may be used to adjust for variations in the length size of the tees 12.

The tee 12 is passed through the opening 26 and the stem 48 is used to force the spring fingers 34, 36 apart and positioned therebetween. The tee 12 is forced into the ground by applying downward pressure on the handle 16 of the stick 10 (FIG. 2). The tip 57 of the tee 12 penetrates the ground via opening 26 at the bottom of the head 18 as the top 56 of the tee 12 contacts the cap 54 of the screw 50 and prevents any further upward movement of the tee 12. After the tee 12 is securely embedded in the ground, the tee stick 10 is pushed horizontally in the forward direction away from the tee 12, and thereby disengaging and releasing the tee from the spring 32 (see FIG. 3). The stick 10 is finally disassociated with the tee as the opening 26 at the back wall 28 is moved past the tee.

The horizontal leg 22 of the head 18 includes a body portion 58 having a concave seat 60 on the top side 61 thereof for holding the golf ball, and the seat 60 decreases in area inwardly. A hole 62 is centrally positioned in the seat 60 and extends through the body 58 to the bottom wall 64 of the horizontal leg 22, adjacent to the bottom wall 30 of the vertical leg 20. The seat 60 is of sufficient size to enable the golf ball to be moved forward or rearward toward the vertical leg 20 when positioning the ball on the tee.

A tong 66 spaced from tong 68 protrudes out from the body 58 and defines a channel 69 therebetween which communicates with the hole 62.

The side edge 70 of body 58 includes a groove 72 (FIGS. 7, 8 and 9) to provide an upward curved inclining ramp for rolling the golf ball 14 from off the ground into the seat 60 (FIG. 7) with a push of the player's foot. The diameter of hole 62 and the width of channel 69 are dimensioned larger than the top 56 of the tee 12 but smaller than the diameter of the ball 14.

After the ball 14 is nestled in the seat 60, the stick 10 is raised and then lowered above the tee 12 and then placed on the tee 12 so that the top 56 of the tee lifts the ball above the seat 60. The stick 10 is now pulled in the rear or backward direction, so that the channel 69 between the tongs 66, 68, moves past the tee with the golf ball resting thereon.

Figure 5:
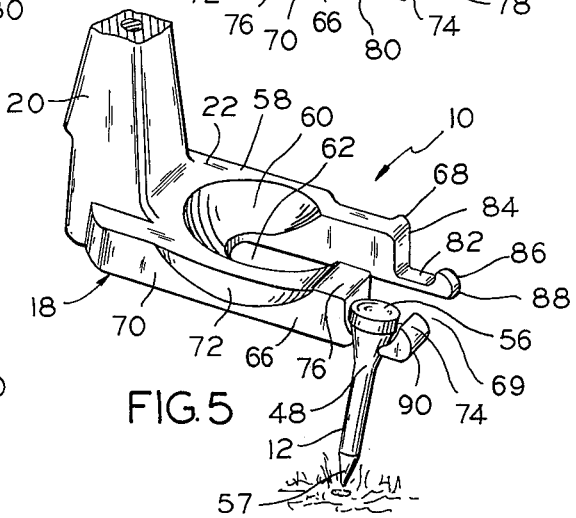
FIG. 5 is a perspective front side view of the stick device illustrating the tee being lifted out from the ground.

The tong 66 comprises a ledge 74 located between a shoulder 76 and a hump 78. An annular notch 80 is cut out from the ledge 74 adjacent the side edge 70 and dimensioned greater than the diameter of tee stem 48 but less than the diameter of the top 56 of the tee. To pull the tee out from the ground, the notch 80 is placed around the stem 48 of the tee and the top of the tee extends above the ledge 74 (FIG. 5). The upper part of the tee below the top 56 abutts the ledge 74, as an upward force is applied to the handle 16, thereby lifting the tee out from the ground to be easily picked off the stick 10 by the player.

Figure 6:
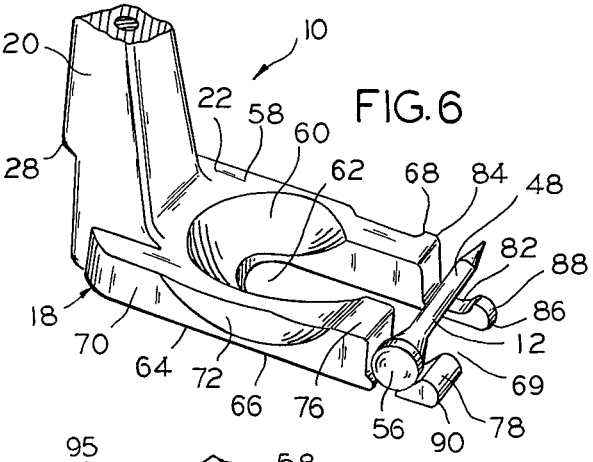
FIG. 6 is a perspective front view illustrating the tee cradled in the two front tongs of the stick after being picked up from the ground.

The tong 68 also includes a ledge 82 located between a shoulder 84 and a hump 86. Ledge 82 is aligned with ledge 74 of tong 66. The forward portion 88 of hump 86 is convex curved, and the forward portion 90 of hump 78 is also convex curved. The cooperation of ledges 74, 82, shoulders 76, 84 and humps 78, 86 provide a pick-up cradle for the tee 12. When the tee is lying on the grass or ground, which may occur when the tee is knocked out from its upright position in the ground after driving the golf ball, the forward portions 88, 90 of humps 78, 86 are used to slide under the tee, which may be held stationary by the foot of the player, and lifted over the humps 78,86 and on to the ledges 74, 82 (FIG. 6). For greatest stability the larger forward portion 90 of tong 66 should be positioned underneath the top of the tee, and the stem of the tee prodded upward with the smaller forward portion 90 of tong 68.

The forward portions 88,90 of the tongs 66, 68 (FIGS. 8 and 10) are further utilized to push out the ball from the cup 92 positioned in the hole 93 (see FIG. 9) and the humps 78, 86 and shoulders 76, 84 afford support for the ball 14. After the ball has been lifted out of the hole 93, it is rolled on the ramp 72 and into the seat 60, and the stick 10 is raised upward to enable the player to remove the ball from the seat 60.

Figure 14:
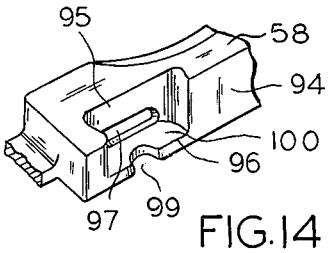
FIG. 14 is an enlarged fragmentary perspective view to illustrate the slot and platform for supporting the ball marker shown in FIG. 10.
Figure 7:
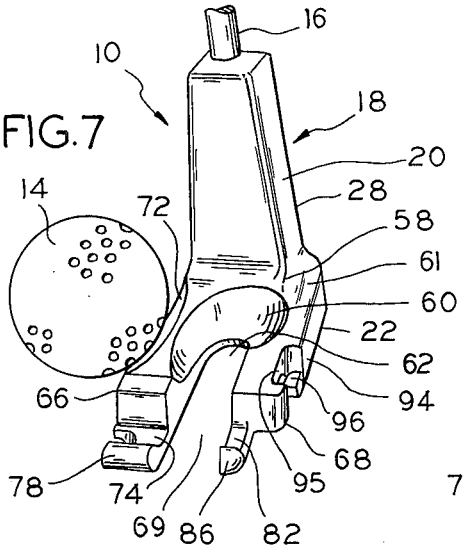
FIG. 7 illustrates the ball moving into the groove for positioning in the seat of the stick device.
Figure 10:
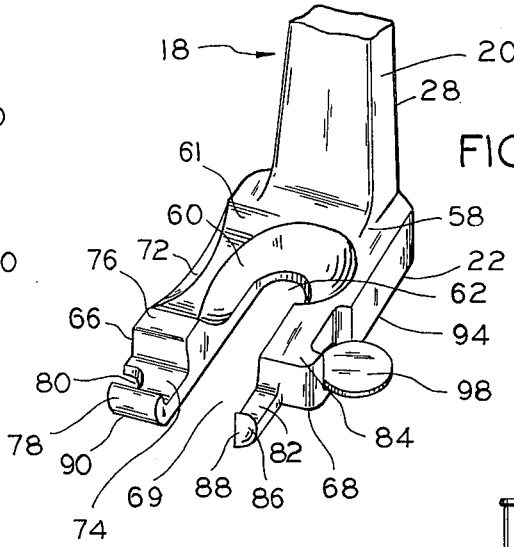
FIG. 10 is a front side view, opposite to the side view in FIG. 4, of the stick and showing a ball marker inserted in the slot of the stick.
Figure 8:
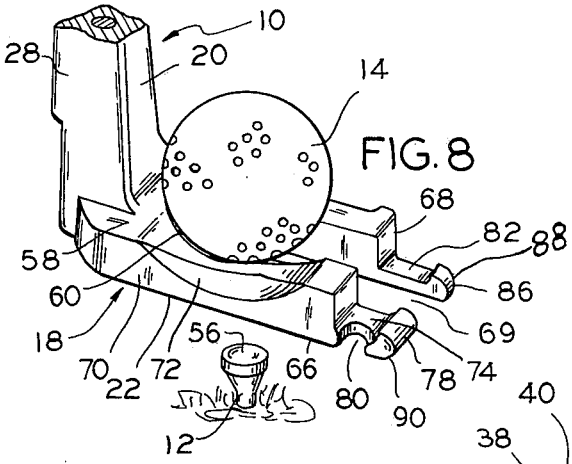
FIG. 8 illustrates the stick raised above the tee and the golf ball positioned in the seat of the stick.
Figure 12:
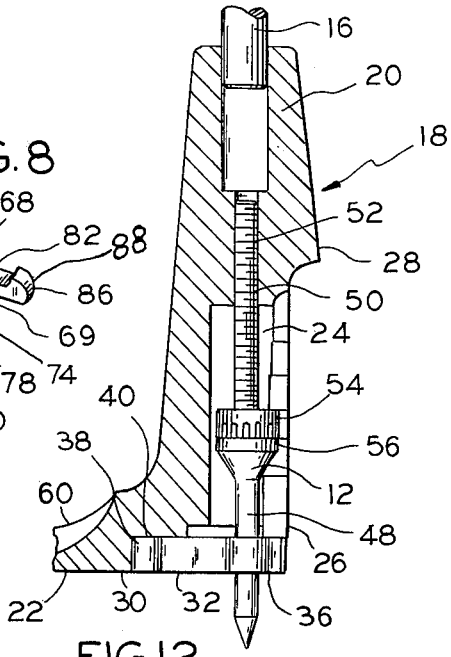
FIG. 12 is an enlarged fragmentary section view with portions cut away for viewing the contact of the tee with the adjustible screw and the adjacent structure thereto.

Turning now more specifically to FIGS. 7, 10 and 14, it will be seen that the side edge 94 is notched to provide a recessed wall 95 and a platform 96. A slot 97 is formed in the wall 95. A ball marker 98 extends into the slot 97 and is supported on the platform 96. A cutout 99 is formed in the platform 96 to receive the pin (not shown) of those ball markers 98 having a flat head as shown in FIG. 10 and a centrally located pin for inserting the ball marker 98 into the ground, to prevent displacement or any shift of position.

The platform 96 includes a downward inclining outer surface 100 until reaching the slot 97. Thus, the ball marker 98 is angularly supported on the tee stick 10. By tilting side edge 70 upward and away from the ground, the ball marker slips out at the desired location next to the ball and is pushed into or onto (depending whether the ball marker 98 is flat or has a protruding pin) the ground at the location for the ball, when the ball is moved away to permit another player to putt into the cup 92.

The golf tee and ball stick device 10 provides a complete means for the incapacitated person, unable to kneel or bend over, to participate independently and without assistance in the sport of golf. The tee is easily and securely placed by hand in the spring 32 inside the head 18, and the depth that the tee will be inserted in the ground is set with screw 50 and the level that it extends inside the cavity 24 for contact with the top 56 of the tee. The application of a downward force on the handle 16 forces the tee in the ground. Upon moving the tee horizontally in the forward direction as viewed in FIG. 3, the tee is easily released from the spring 32.

The golf ball 14 is positioned in the seat 60 and the stick 10 is lowered over the tee, enabling the top of the tee to force the ball out of the seat and rest on top of the tee. Upon moving the stick 10 in a downward and backward direction, as viewed in FIG. 8, the stick 10 moves past the tee and ball resting thereon via the pathway provided by the channel 69.

The ball is retrieved from the ground or green by rolling the ball on the groove 72 with the foot and into the seat 60, when the head 18 is placed on the ground.

As may be seen in FIG. 5, the tee is retrieved when embedded in the ground, by lifting upward on the jaw comprising the ledge 74 and notch 80, which enables the tee to be pulled out from the ground. When the tee is lying loose on grass, the forward portions 88,90 of the tongs 66 and 68 respectively, are used to push under and roll the tee over the humps 74 and 86 and into the cradle shown in FIG. 6, provided by the cooperation of the ledges 74, 82, shoulders 76, 84 and the humps 78, 88. The foot may again be used to brace or block tee movement except into the cradle of the tongs 66, 68.

Figure 9:
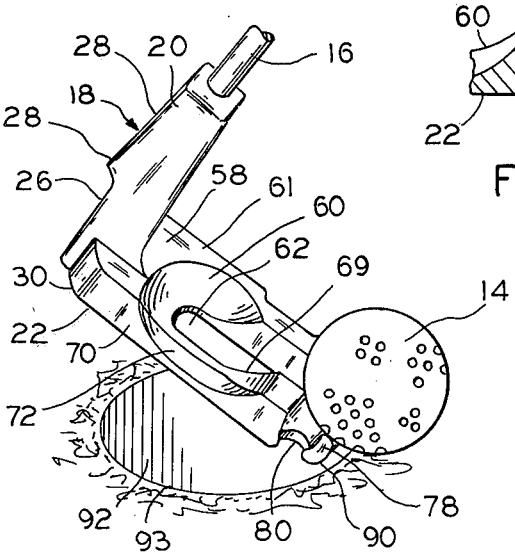
FIG. 9 illustrates the prongs of the stick pulling the ball upward and out of the cup of the hole.
Figure 11:
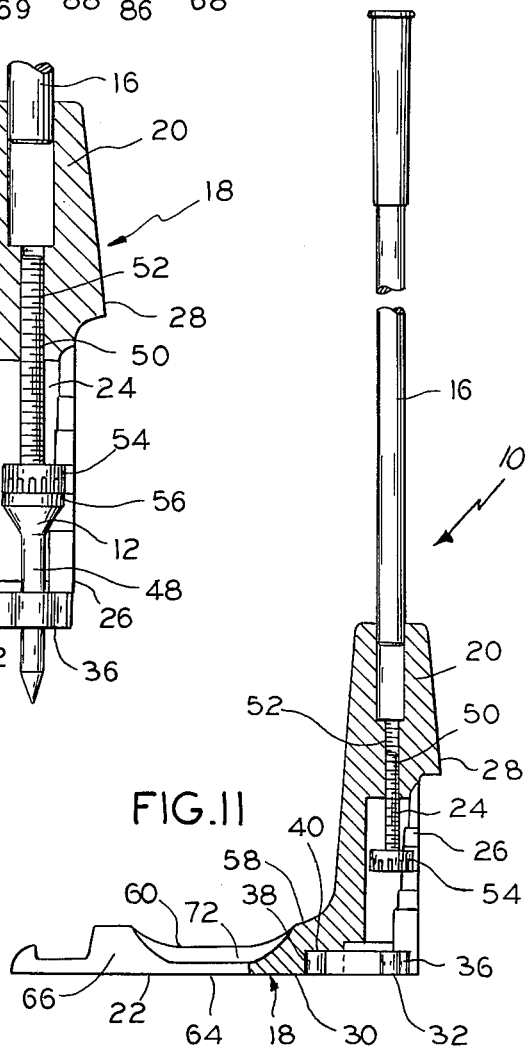
FIG. 11 is a sectional fragmentary side view of the tee and ball stick device.

The outer end portions 90, 88 of the tongs 66, 68 are further utilized to reach into and prod the golf ball up and out of the cup 92, as shown in FIG. 9.

As may be seen in FIGS. 7, 10 and 14, a slot 97 to receive a portion of a ball marker 98 and the ball marker is supported on a platform 96 inclining upward from the slot. The ball marker is easily placed on or into the ground by merely tilting the stick 10, so that the ball marker slides downward on platform 96 and on to the ground. The side edge of the foot may be used to lift the ball marker back onto the platform 96 and into the slot 97. If the ball marker 98 includes a protruding tip, the tip is received in the cut out area 99.

The description of the preferred embodiments of this invention is intended merely as illustrative of the subject invention, the scope and limits of which are set forth in the following claims:

I claim:

1. In a stick device for use with a golf tee and ball and comprising a handle attached to a head, said head including:

a spring having a pair of fingers which spread apart to an open position from a closed position for receiving the tee and thereby resiliently clamping the tee in place, and said fingers returning to the closed position after the tee is disengaged from the spring upon the application of a lateral force to the handle, said spring receiving the tee prior to inserting the tee in the ground; and contacting member spaced above said spring and in a fixed position for providing an abutting surface for the top of the tee when the tee is inserted in the ground upon the application of a downward force to the handle.

2. The stick device of claim 1, wherein the outer penetrating tip of the tee extends out from the bottom of said head prior to inserting the tee in the ground.

3. The stick device of claim 1, wherein an opening is formed in the head for passing the tee into and out from said holding means.

4. The stick device of claim 1, wherein said contacting member being adjustible for varying the fixed position thereof, to thereby determine the length of the tee being inserted in the ground.

5. The stick device of claim 2, wherein said contacting member is a screw having a threaded shank extending upward from a cap; and a threaded opening formed in the head to receive said shank of the screw, the rotating of said cap varying the fixed position of the screw.

6. The stick device of claim 1, wherein said head includes a back section and a forward section;

a cavity being formed in the back section; and an opening communicating the outside with the cavity, said spring being mounted in the back section so that the spring is positioned in the cavity, said tee being insertible in the spring via said opening, said tee being released from the spring and disassociated from the stick as said opening clears said tee when the stick is moved laterally in the forward direction.

7. The stick device of claim 1, wherein said head includes:

a body portion having an annular seat;

a hole centrally positioned in the seat and passing through the body and being dimensioned greater than the top of the tee and smaller than the diameter of the golf ball; and a channel communicating the hole with the outside, said ball being positioned in the seat above the hole for placement on the tee, said ball being positioned on the tee upon lowering the stock so that the tee lifts the ball from the seat and said stick being removable upon laterally pulling the stick until the tee clears said channel.

8. The stick device of claim 7, wherein a groove is formed in the edge of said body for rolling the golf ball into the seat.

9. The stick device of claim 8 includes a pair of tongs extending out from said body and spaced apart, each of said tongs including a forward hump, a shoulder and a ledge therebetween, said tee being cradled on said ledges between said shoulders and humps, after said tee is lifted from the ground.

10. The stick device of claim 9, wherein an arcuate notch is formed in one of said ledges, said notch being dimensioned less than the diameter of the top of the tee for receiving the neck of the tee between the top and stem of the tee for pulling the tee out from the ground.

11. The stick device of claim 8, wherein the forward portion of each of said humps is curved for rolling said tee into said ledges.

12. The stick device of claim 7, wherein a notch is formed in said head for receiving a ball marker, said ball marker slipping out from said notch when said head is tilted upward on the side of the head opposite to the side of said notch.

13. The stick device of claim 12, wherein a platform is formed forward of said notch for supporting said ball marker when a portion of the ball marker extends into the notch.

14. The stick device of claim 13, wherein said platform is tilted upward, so that said ball marker slants upward when said portion of the ball marker is in said notch.

15. The stick device of claim 14, wherein a pair of tongs extending out from said body and spaced apart, each of said tongs including a forward hump, a shoulder and a ledge therebetween, said tee being cradled on said ledges between said shoulders and humps, after said tee is lifted from the ground.

16. The stick device of claim 15, wherein the forward portion of each of said humps is curved for rolling said tee into said ledges.

17. The stick device of claim 16, wherein an arcuate notch is formed in one of said ledges, said notch being dimensioned less than the diameter of the top of the tee for receiving the neck of the tee between the top and stem of the tee for pulling the tee out from the ground.

18. The stick device of claim 15, wherein said marker includes a pin for securing the ball marker to the ground and a cut out is formed in the platform to receive the pin of the ball marker.

19. In a stick device for use with a golf tee and ball and comprising a handle attached to a head, said head including:

a body portion having an annular seat for receiving said ball;

a hole centrally positioned in the seat and passing through the body to enable said tee to pass through for lifting said ball out of the seat;

a channel communicating the hole with the outside to permit said stick device to be moved laterally away from the tee after the ball has been positioned on the tee;

a groove formed in the edge of said body for rolling the golf ball into the seat; and a notch formed in said head for receiving a ball marker and permitting said ball marker to slip out from the notch and on to the ground when the head is tilted so that the notch is angled toward the ground.

20. The stick device of claim 19, wherein a platform is formed forward of said notch for supporting said ball marker when a portion of the ball marker extends into the notch.

21. In a stick device for use with a golf tee and ball and having a handle attached to a head, said head including:

a body portion;

a pair of tongs extending out from said body and spaced apart, each of said tongs including a forward hump, a shoulder and a ledge between said hump and shoulder, each of said humps including a forward curved portion for rolling said tee over said humps and on to said ledges; and a notch formed in one of said ledges, said notch being dimensioned less than the diameter of the top of the tee for receiving the neck of the tee between the top and stem of the tee for pulling the tee out from the ground.

* * * * *